US010651602B2

(12) United States Patent
Feng et al.

(10) Patent No.: US 10,651,602 B2
(45) Date of Patent: May 12, 2020

(54) ELECTRICAL CONNECTOR THAT REDUCES TRANSMISSION LOSS OF HIGH-SPEED SIGNALS

(71) Applicant: LOTES CO., LTD, Keelung (TW)

(72) Inventors: Zhi Jun Feng, Keelung (TW); Kang Wang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/426,238

(22) Filed: May 30, 2019

(65) Prior Publication Data

US 2019/0372274 A1 Dec. 5, 2019

(30) Foreign Application Priority Data

May 31, 2018 (CN) ..... 2018 1 0550584

(51) Int. Cl.
*H01R 13/6471* (2011.01)
*H01R 12/72* (2011.01)
(Continued)

(52) U.S. Cl.
CPC ..... *H01R 13/6471* (2013.01); *H01R 12/721* (2013.01); *H01R 12/732* (2013.01);
(Continued)

(58) Field of Classification Search
CPC .... H01R 12/73; H01R 12/13; H01R 12/6461; H01R 33/94; H01R 13/6471;
(Continued)

(56) References Cited

U.S. PATENT DOCUMENTS 7,467,955 B2 * 12/2008 Raistrick ..... H01R 13/26 439/75
7,497,736 B2 * 3/2009 Minich ..... H01R 24/30 439/607.05
(Continued)

FOREIGN PATENT DOCUMENTS

CN 100389523 C 5/2008
CN 201142382 Y 10/2008
(Continued)

*Primary Examiner* — Travis S Chambers
(74) *Attorney, Agent, or Firm* — Locke Lord LLP; Tim Tingkang Xia, Esq.

(57) ABSTRACT

An electrical connector includes an insulating block, and multiple differential signal terminals and multiple ground terminals embedded in the insulating block. Multiple first protruding blocks and multiple second protruding blocks protrude and extend forward from a front surface of the insulating block. A slot is formed between the first protruding block and the second protruding block adjacent to each other. Each differential signal terminal is embedded in and extends forward out of a first protruding block. Each of left and right sides of one pair of differential signal terminals has a first side surface. Each ground terminal is provided between two adjacent pairs of the differential signal terminals, and is embedded in and extends forward out of a second protruding block. Each of left and right sides of the ground terminal has a second side surface. A medium between the first side surface and the second side surface is air.

19 Claims, 8 Drawing Sheets

(51) Int. Cl.

| | |
|---|---|
| ***H01R 12/73*** | (2011.01) |
| ***H01R 13/405*** | (2006.01) |
| ***H01R 13/46*** | (2006.01) |
| ***H01R 31/06*** | (2006.01) |

(52) U.S. Cl.
CPC ..... *H01R 13/405* (2013.01); *H01R 13/46* (2013.01); *H01R 31/06* (2013.01)

(58) Field of Classification Search
CPC .. H01R 12/721; H01R 12/732; H01R 13/405; H01R 13/46; H01R 31/06; H04B 2201/709709; Y10S 439/941
USPC ..... 439/61, 637, 638, 947, 59
See application file for complete search history.

(56) References Cited

U.S. PATENT DOCUMENTS

| | | | | |
|---|---|---|---|---|
| 8,465,327 | B2 * | 6/2013 | Springer | H01R 13/6471 439/631 |
| 10,361,499 | B2 * | 7/2019 | Pao | H01R 12/727 |
| 2014/0310957 | A1 * | 10/2014 | Buck | H01R 12/585 29/882 |
| 2018/0115117 | A1 * | 4/2018 | Yu | H01R 12/79 |

FOREIGN PATENT DOCUMENTS

| | | | |
|---|---|---|---|
| CN | 202076592 | U | 12/2011 |
| CN | 101609935 | B | 11/2012 |
| CN | 204216285 | U | 3/2015 |
| CN | 104659573 | B | 2/2018 |
| CN | 207320484 | U | 5/2018 |
| TW | M431490 | U | 6/2012 |

* cited by examiner

ELECTRICAL CONNECTOR THAT REDUCES TRANSMISSION LOSS OF HIGH-SPEED SIGNALS

CROSS-REFERENCE TO RELATED PATENT APPLICATION

This non-provisional application claims priority to and the benefit of, pursuant to 35 U.S.C. § 119(a), patent application Serial No. CN201810550584.8, filed in China on May 31, 2018. The disclosures of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector for transmitting high-speed signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the mass demand for the high transmission rate of electronic products, most electrical connectors nowadays have to consider high frequency requirements. A conventional electrical connector is used for implementing an electrical connection between an electronic card and a circuit board to achieve signal transmission. The electrical connector has an insulating shell, the front end thereof has an insertion slot for accommodating an electronic card, and the rear end thereof has a mounting slot for accommodating a terminal module. The terminal module has multiple terminals and an insulating block injection-molded with the terminals. The terminals include multiple pairs of differential signal terminals for transmitting high-frequency signals and multiple ground terminals respectively located between each two adjacent pairs of differential signal terminals. Each of the terminals has a fixing portion embedded in the insulating block. A contact arm extends from the front end of the fixing portion and extends forward out of the insulating block, and is exposed in the insertion slot for electrically contacting the electronic card. A soldering portion extends backward from the rear end of the fixing portion out of the insulating block for electrically connecting a circuit board.

However, the fixing portion is embedded in the insulating block, and the elastic arm is exposed to the air. When the signal is transmitted from the fixing portion to the elastic arm, the dielectric constant of the air is less than the dielectric constant of the insulating block, and the capacitance between the ground terminal and the adjacent differential signal terminal decreases due to the decrease of the dielectric constant, thereby resulting in a change in the impedance between the ground terminal and the adjacent differential signal terminal, and causing high-speed signal loss and crosstalk.

Therefore, a heretofore unaddressed need to design a new electrical connector exists in the art to address the aforementioned deficiencies and inadequacies.

SUMMARY

The present invention is directed to a high-frequency electrical connector that inhibits the decrease in capacitance when high-speed signals are transmitted from plastic to air, thereby reducing the transmission loss of high-speed signals.

To achieve the foregoing objective, the present invention adopts the following technical solutions: an electrical connector is configured for a mating component to be backwardly inserted thereto, and includes: an insulating block, having a front surface, wherein a plurality of first protruding blocks and a plurality of second protruding blocks protrude and extend forward from the front surface, one of the first protruding blocks and one of the second protruding blocks are provided adjacent to each other, and a slot is formed between the one of the first protruding blocks and the one of the second protruding blocks adjacent to each other; a plurality of differential signal terminals, embedded in the insulating block and forming a plurality of pairs of the differential signal terminals, wherein each of the differential signal terminals has a first retaining portion embedded in a corresponding first protruding block of the first protruding blocks, and a first elastic arm formed by extending forward from the first retaining portion and protruding forward out of the corresponding first protruding block, the first elastic arm is configured to be in electrical contact with the mating component, and each of a left side and a right side of each of the pairs of the differential signal terminals has a first side surface; and a plurality of ground terminals, embedded in the insulating block, wherein each of the ground terminals is provided between two adjacent pairs of the differential signal terminals, each of the ground terminals has a second retaining portion embedded in a corresponding second protruding block of the second protruding blocks, and a second elastic arm formed by extending forward from the second retaining portion and protruding forward out of the corresponding second protruding block, the second elastic arm is configured to be in electrical contact with the mating component, each of a left side and a right side of each of the ground terminals has a second side surface, and each of the second side surfaces and a corresponding first side surface adjacent thereto are exposed in the slot, such that a medium between the first side surface and the second side surface is air.

In certain embodiments, the electrical connector further includes an insulating shell configured to accommodate the mating component, wherein the insulating shell has a plurality of terminal slots, a partition wall is provided between two adjacent ones of the terminals slots, the first elastic arm and the second elastic arm are respectively correspondingly accommodated in the terminal slots, and the slot is located behind the partition wall.

In certain embodiments, the insulating block further has a rear surface, the rear surface and the front surface are provided opposite to each other, the rear surface is backward protruding provided with a plurality of third protruding blocks and a plurality of fourth protruding blocks, the third protruding blocks and the first protruding blocks are one-to-one correspondingly provided in a front-rear direction, the fourth protruding blocks and the second protruding blocks are one-to-one correspondingly provided in the front-rear direction, and a through slot is formed between one of the third protruding blocks and one of the fourth protruding block adjacent to each other; and each of the differential signal terminals has a third elastic arm extending backward beyond a corresponding third protruding block of the third protruding blocks and configured to be electrically connected to a circuit board, each of the ground terminals has a fourth elastic arm extending backward beyond a corresponding fourth protruding block of the fourth protruding blocks and configured to be electrically connected the circuit board, and the through slot is located between the third elastic arm and the fourth elastic arm.

In certain embodiments, a width of each of the first protruding blocks is greater than a width of each of the second protruding blocks, the width of each of the first protruding blocks is equal to a width of each of the third protruding blocks, and the width of each of the second protruding blocks is equal to a width of each of the fourth protruding blocks.

In certain embodiments, one of an upper surface and a lower surface of the third elastic arm is abutted by the corresponding third protruding block, the other of the upper surface and the lower surface of the third elastic arm is exposed to the corresponding third protruding block, one of an upper surface and a lower surface of the fourth elastic arm is abutted by the corresponding fourth protruding block, and the other the upper surface and the lower surface of the fourth elastic arm is exposed to the corresponding fourth protruding block.

In certain embodiments, a length of the first elastic arm is greater than a length of the first retaining portion; and a length of the second elastic arm is greater than a length of the second retaining portion.

In certain embodiments, the insulating block has a hole located on a rear side of the slot, and the first retaining portion is at least partially exposed in the hole.

In certain embodiments, a center of the first retaining portion has a narrow portion, a width of the narrow portion is less than a width of each of a front end and a rear end of the first retaining portion, and the narrow portion is exposed in the hole.

In certain embodiments, a left side surface and a right side surface of each of the first protruding blocks are respectively correspondingly flush with two corresponding ones of the first side surfaces.

In certain embodiments, two corresponding ones of the second side surfaces are respectively flush with a left side surface and a right side surface of each of the second protruding blocks.

In certain embodiments, the first elastic arm has a first contact portion electrically connected with the mating component, a width of the first contact portion is less than a width of each of the first protruding blocks, the second elastic arm has a second contact portion mated with the mating component, a width of the second contact portion is less than a width of each of the second protruding blocks, and a distance between the first contact portion and an adjacent second contact portion is greater than a distance between the one of the first protruding blocks and the one of the second protruding blocks adjacent to each other.

In certain embodiments, the first retaining portions of each of the pairs of the differential signal terminals are embedded in a same corresponding one of the first protruding blocks, each of the first elastic arms of each of the pairs of the differential signal terminals has a first section connected to the same corresponding one of the first protruding blocks, the same corresponding one of the first protruding blocks defines a first central line in a front-rear direction, the first section of each of the first elastic arms of each of the pairs of the differential signal terminals defines a second central line in the front-rear direction, and two adjacent second central lines are symmetrical to each other about the first central line.

In certain embodiments, a first contact portion is formed at an end of the first elastic arm to be electrically connected to the mating component, a width of the first contact portion is less than a width of the first section, the first contact portion defines a third central line in the front-rear direction, and the third central line is located farther away from the first central line than the second central line.

In certain embodiments, a second section connects the first contact portion and the first section, a width of the second section is less than the width of the first section and is greater than the width of the first contact portion, the second section defines a fourth central line in the front-rear direction, and the fourth central line is located closer to the first central line than the second central line.

Compared with the related art, in certain embodiments of the present invention, the front surface of the insulating block is protrudingly provided with multiple first protruding blocks and multiple second protruding blocks alternately provided. A slot is formed between the first protruding block and the second protruding block adjacent to each other. The second side surface of a ground terminal and the first side surface of an adjacent differential signal terminal are exposed in the slot, such that the medium between the first side surface and the second side surface adjacent thereto is air, thereby increasing a directly facing area in air between the ground terminal and the adjacent differential signal terminal. When a signal is transmitted from the insulating block into the air, the decrease of the capacitance between the ground terminal and the adjacent differential signal is inhibited, thereby inhibiting the amplitude of fluctuation of impedance. Thus, the impedance is maintained at a relatively stable value, thereby reducing the transmission loss, reducing the cross talk, and facilitating the transmission of high-frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
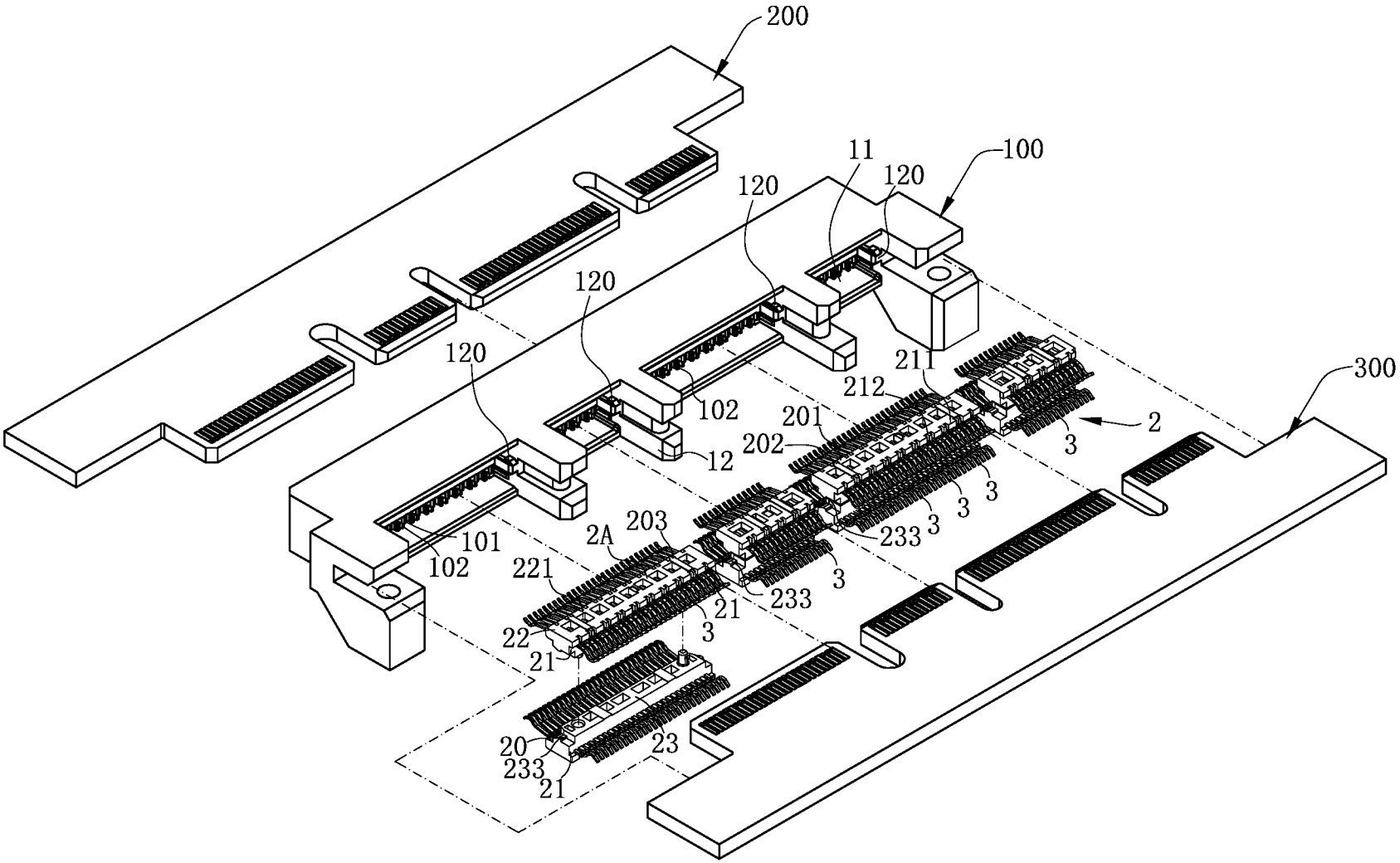
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 2:
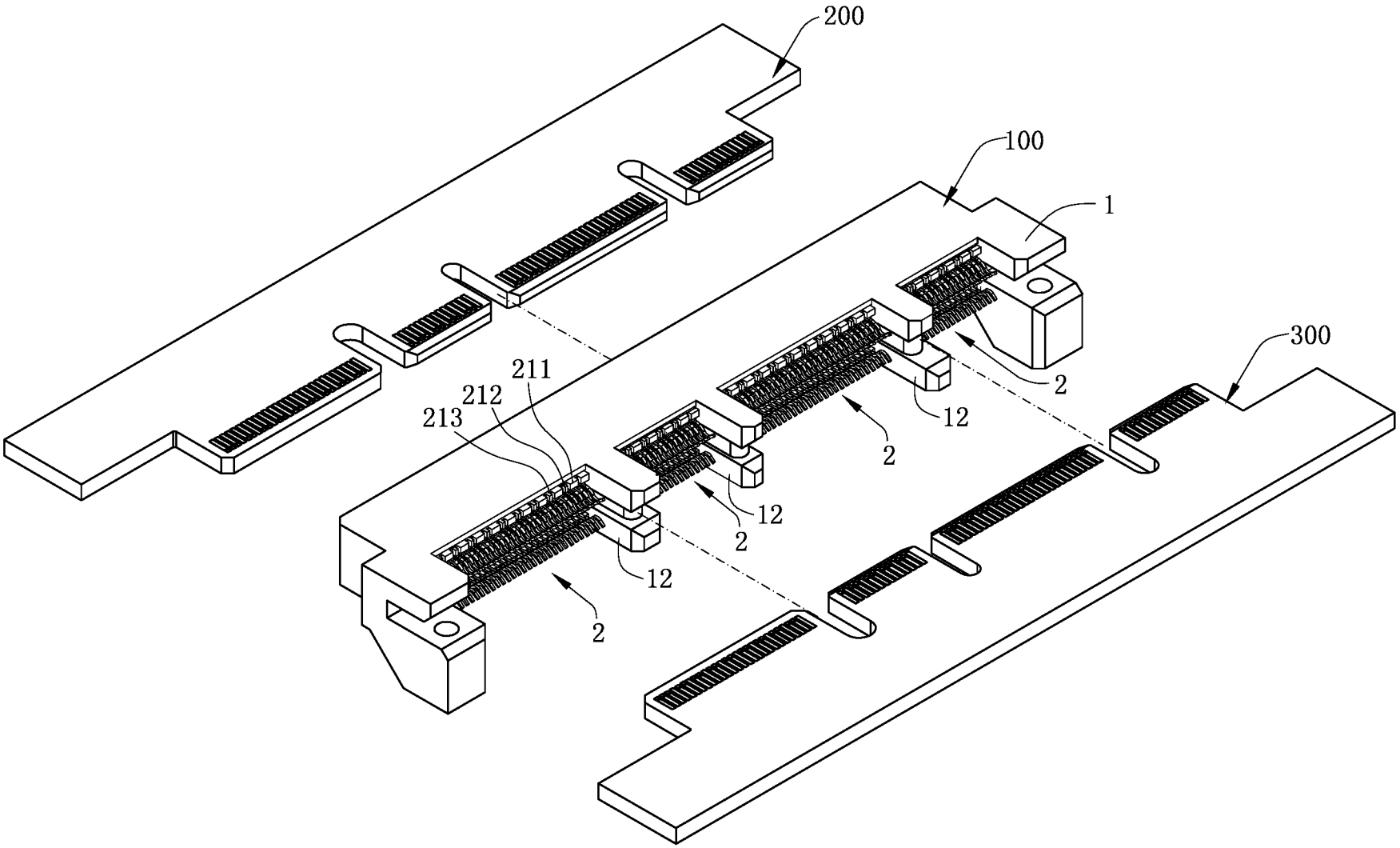
FIG. 2 is a perspective assembled view of the electrical connector in FIG. 1.
Figure 3:
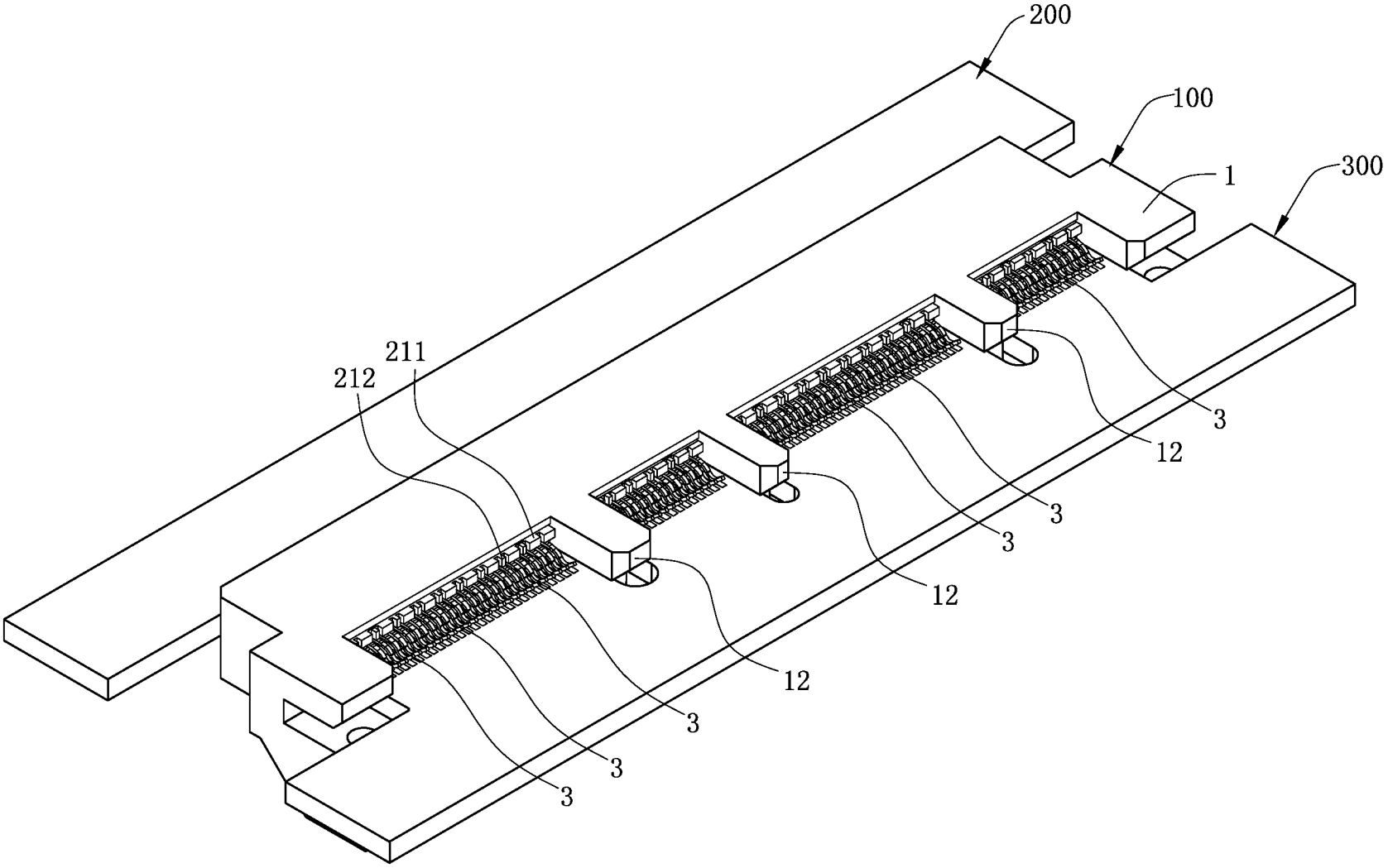
FIG. 3 is a perspective assembled view of an electronic card and a circuit board being assembled to the electrical connector in FIG. 2.

Referring to FIG. 1, FIG. 2 and FIG. 3, an embodiment of the present invention is provided. An electrical connector 100 is configured to be electrically connected to an electronic card 200 and a circuit board 300, and includes an insulating shell 1 and multiple terminal modules 2 provided in an upper row and a lower row and mounted in the insulating shell 1. Each terminal module 2 includes an insulating block 2A and multiple terminals 3 embedded in the insulating block 2A. The terminals 3 of the terminal module 2 in the upper row and the terminals 3 of the terminal module 2 in the lower row are in 180° inversion symmetrical arrangement in a vertical direction and jointly clamp the electronic card 200 vertically.

Figure 4:
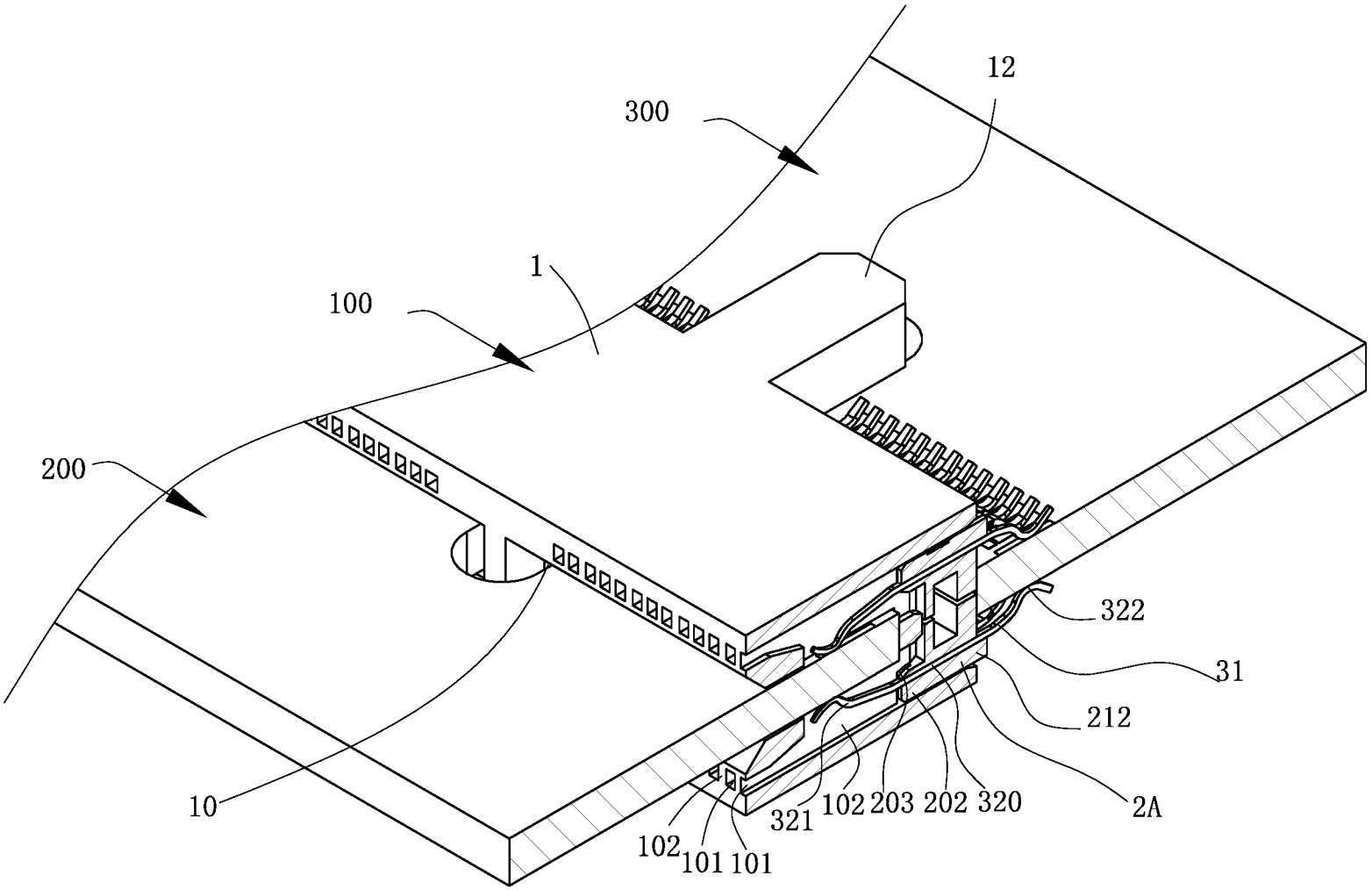
FIG. 4 is a perspective sectional view of the electronic card and the circuit board being assembled to the electrical connector in FIG. 3.
Figure 5:
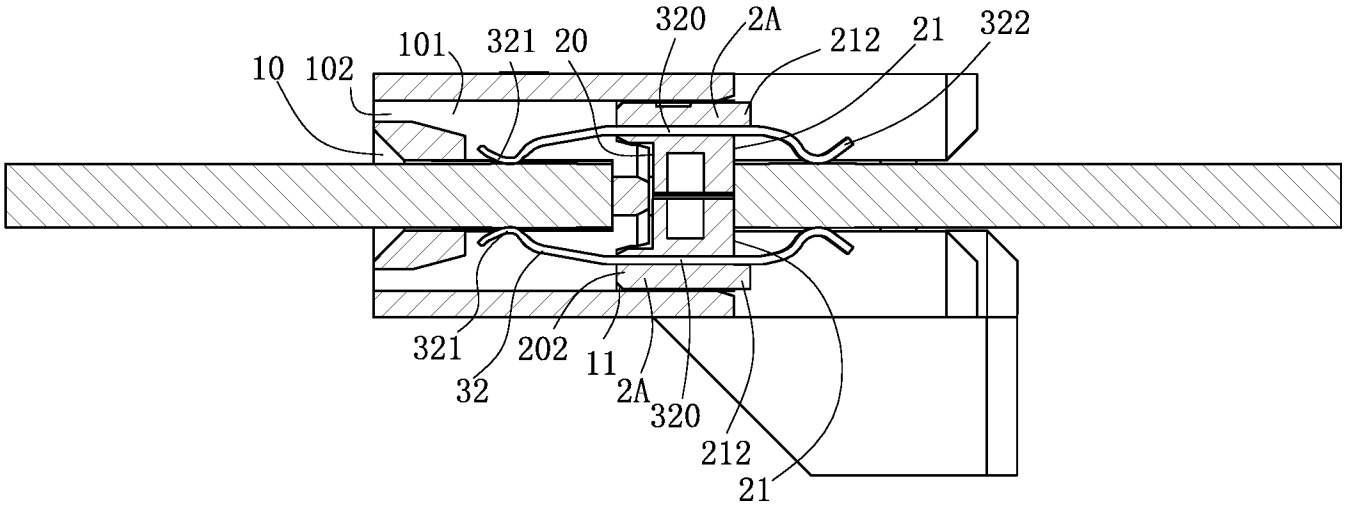
FIG. 5 is a planar sectional view of FIG. 4.

Referring to FIG. 1, FIG. 4 and FIG. 5, the insulating shell 1 is longitudinally provided along a left-right direction. An accommodating slot 10 is concavely provided backward from a front surface of the insulating shell 1 to accommodate the electronic card 200. The insulating shell 1 is provided with multiple terminal slots 101 which are respectively provided above and below the accommodating slot 10 and arranged in two rows. A partition wall 102 is provided between the two adjacent terminal slots 101. Multiple mounting slots 11 are concavely provided forward from a rear surface of the insulating shell 1 to accommodate the terminal modules 2. The mounting slots 11 communicate with the terminal slots 101. A fastening rib 12 is provided between each two adjacent mounting slots 11, and the fastening rib 12 extends backward beyond the rear surface of the insulating shell 1. Each of the left and right sides of the fastening rib 12 respectively protrudes and extends to form a buckling portion 120 to fasten the corresponding terminal module 2.

Figure 6:
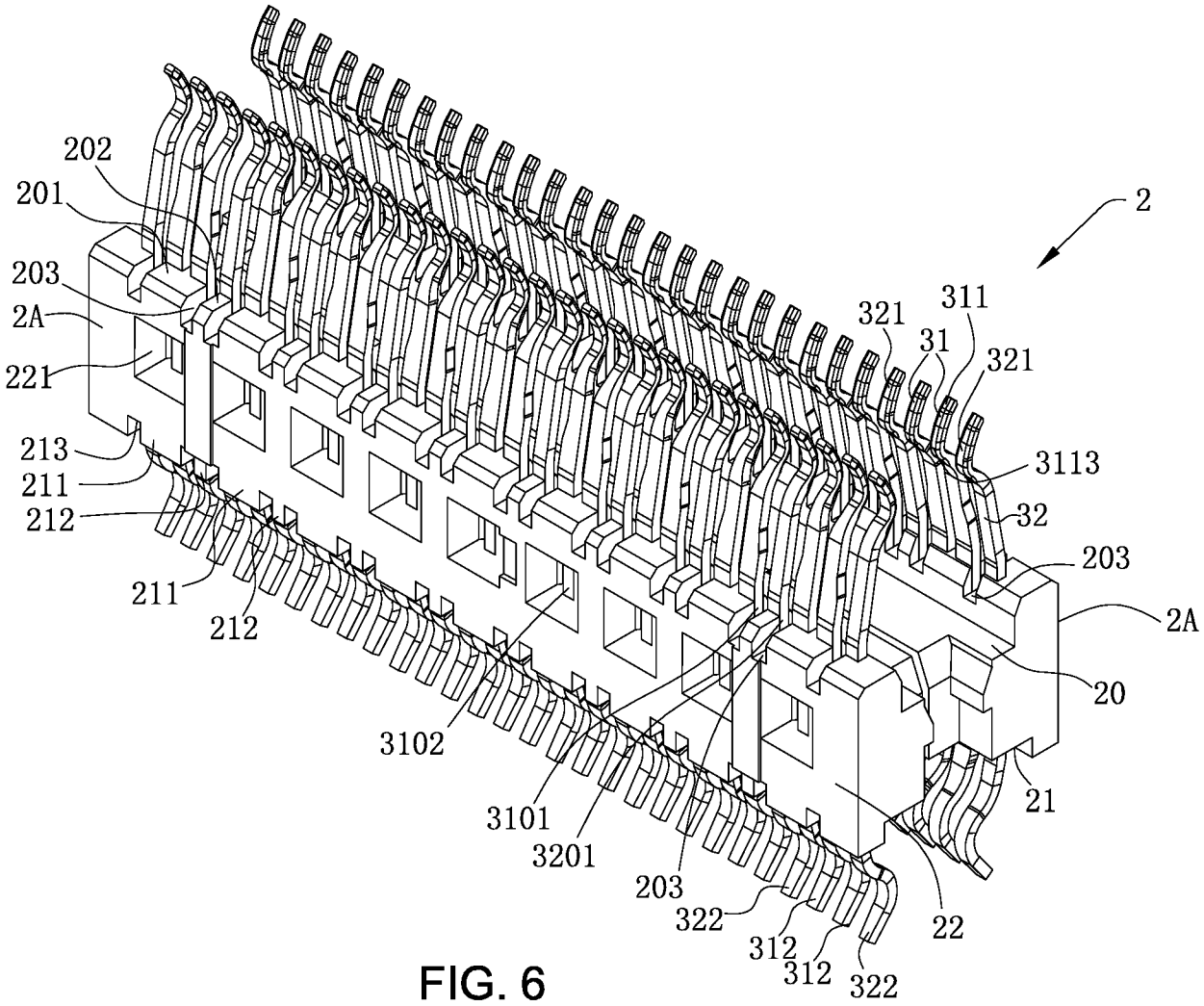
FIG. 6 is a perspective view of a terminal module of the electrical connector in FIG. 1.
Figure 7:
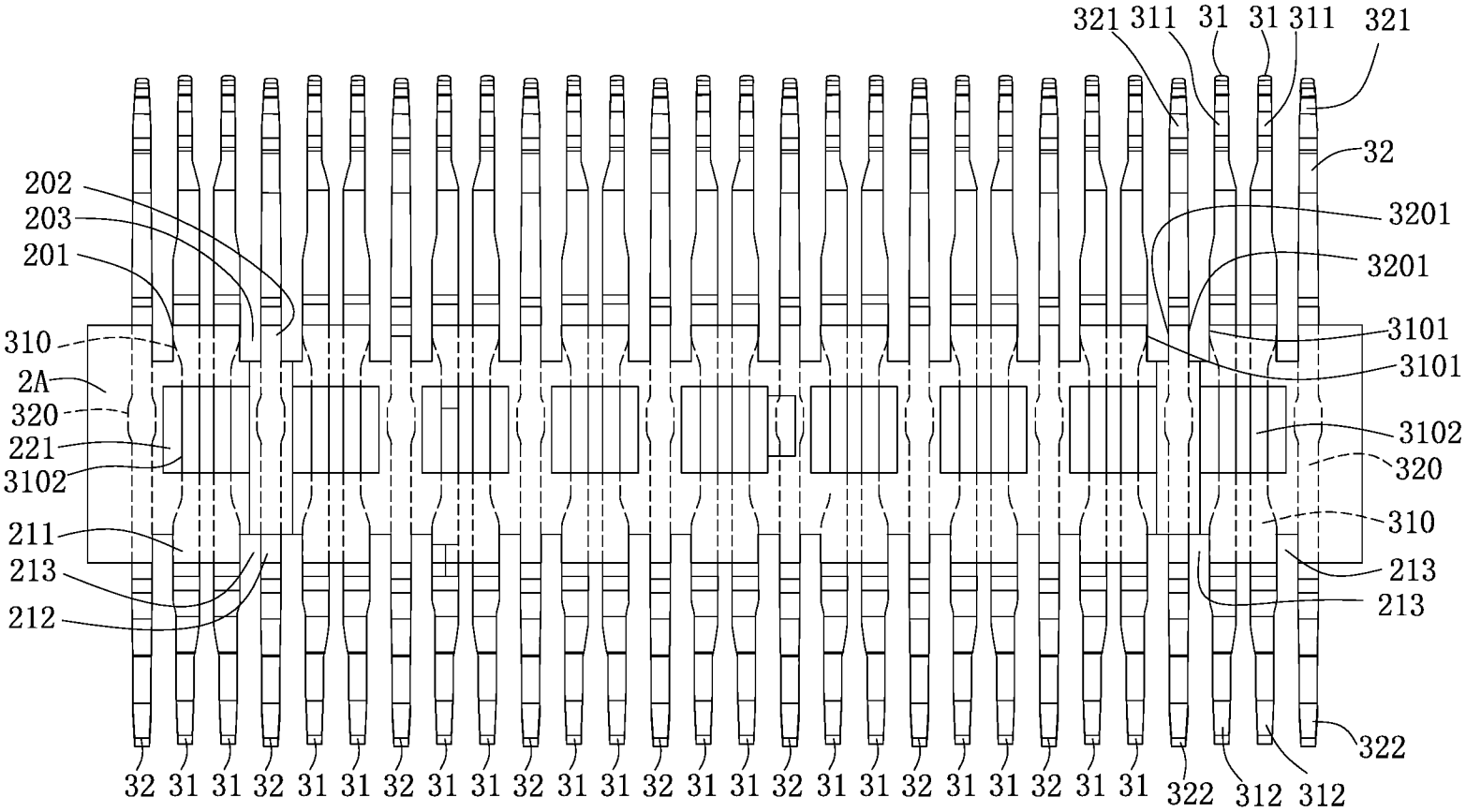
FIG. 7 is a top view of the terminal module in FIG. 6.

Referring to FIG. 1, FIG. 6 and FIG. 7, the insulating block 2A has a front surface 20 and a rear surface 21 provided opposite to each other in a front-rear direction. Multiple first protruding blocks 201 and multiple second protruding blocks 202 are protrudingly provided forward from the front surface 20. A width of each first protruding block 201 is less than a width of each second protruding block 202. The first protruding blocks 201 and the second protruding blocks 202 are alternately provided. A slot 203 is formed between each pair of a first protruding block 201 and a second protruding block 202 adjacent to each other, and each slot 203 extends backward to the front surface 20. The slots 203 are equal in width. Multiple third protruding blocks 211 and multiple fourth protruding blocks 212 are protrudingly provided backward from the rear surface 21. The third protruding blocks 211 and the first protruding blocks 201 are one-to-one correspondingly provided in the front-rear direction, and the width of each first protruding block 201 is equal to a width of each third protruding block 211. The fourth protruding blocks 212 and the second protruding blocks 202 are one-to-one correspondingly provided in the front-rear direction, and the width of each second protruding block 202 is equal to a width of each fourth protruding block 212. A through slot 213 is formed between each pair of a third protruding block 211 and a fourth protruding block 212, and each through slot 213 extends forward to the rear surface 21. The through slots 213 are equal in width.

Referring to FIG. 1, FIG. 6 and FIG. 7, the upper surface 22 of the insulating block 2A is downward concavely provided with multiple holes 221. The holes 221 are arranged in a row on the upper surface 22, and each of the holes 221 is provided between each one-to-one corresponding pair of the first protruding block 201 and the third protruding block 211. Each of the left and right ends of the lower surface 23 of the insulating block 2A has a fastening portion 233 to form a snap fit with the buckling portion 120 in the front-rear direction, thereby preventing the insulating block 2A from being separated backward from the mounting slots 11.

Referring to FIG. 2, FIG. 6 and FIG. 7, the terminal 3 has multiple pairs of differential signal terminals 31 for transmitting high-frequency signals and multiple ground terminals 32 respectively located between each two adjacent pairs of differential signal terminals 31. Each of the differential signal terminals 31 has a first retaining portion 310 embedded in the insulating block 2A and further embedded in a corresponding first protruding block 201. Each pair of the differential signal terminals 31 respectively has two first side surface 3101 on the two outermost sides in the left-right direction, and a distance between the two first side surfaces 3101 is equal to the width of the corresponding first protruding block 201, such that the two first side surfaces 3101 are respectively flush with the left and right side surfaces of the corresponding first protruding block 201 in the vertical direction. Thus, each first side surface 3101 is exposed in a corresponding slot 203.

Referring to FIG. 6 and FIG. 7, a center of the first retaining portion 310 has a narrow portion 3102. A width of the narrow portion 3102 is less than a width of each of a front end and a rear end of the first retaining portion 310, and the narrow portion 3102 is exposed in a corresponding hole 221.

Referring to FIG. 5, FIG. 6 and FIG. 7, a first elastic arm 311 extends forward from the first retaining portion 310. The first elastic arm 311 extends forward out of the first protruding block 201 and is accommodated in a corresponding terminal slot 101, and is exposed in a corresponding accommodating slot 10 to be in electrical contact with the electronic card 200. A width of each of the two first elastic arms 311 is less than one half of the width of the first protruding block 201. The two first side surfaces 3101 located on the far side of a pair of differential signal terminals 31 are respectively exposed at the left and right side surfaces of the first protruding block 201 and flush with the left and right side surfaces of the first protruding block 201. A length of the first elastic arm 311 is greater than a length of the first retaining portion 310. Since the dielectric constant of the air medium is less than the dielectric constant of the insulating block 2A, and the length of the first elastic arm 311 exposed to the air is greater than the length of the first retaining portion 310 embedded in the insulating block 2A, the impedance of the terminal 3 can be effectively adjusted, such that the value of the impedance of the first retaining portion 310 and the value of the impedance of the first elastic arm 311 do not fluctuate greatly, thereby reducing the transmission loss of high-frequency signals and reducing the cross talk, and further improving the high-frequency performance.

Figure 8:
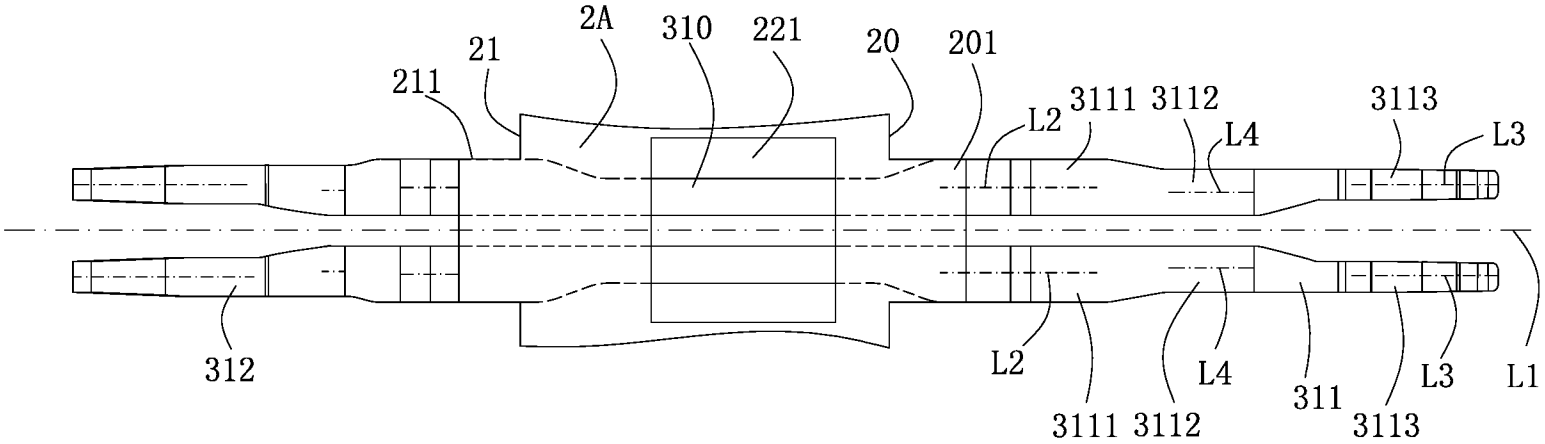
FIG. 8 is a partial sectional view of a pair of differential signal terminals

Referring to FIG. 7 and FIG. 8, the first protruding block 201 defines a first central line L1 in the front-rear direction. The first elastic arm 311 has a first section 3111 connected to the first protruding block 201, and the first section 3111 defines a second central line L2 in the front-rear direction. Two adjacent second central lines L2 are symmetrically provided about the corresponding first central line L1, such that a distance between the two adjacent first sections 311 is constant and the two adjacent first sections 311 face each other, thereby facilitating stability of impedance and facilitating high frequency characteristics thereof. A second section 3112 deviates and extends forward from the first section 3111, and a width of the second section 3112 is less than a width of the first section 3111. The second section 3112 defines a fourth central line L4 in the front-rear direction, and the fourth central line L4 is located closer to the first central line L1 than the second central line L2, thereby adjusting the impedance imbalance phenomenon caused by different widths between the first section 3111 and the second section 3112. A first contact portion 3113 deviates and extends forward from the second section 3112, and a width of the first contact portion 3113 is less than the width of the second section 3112. That is, the width of the first contact portion 3113 is less than the width of the first section 3111. The first contact portion 3113 defines a third central line L3 in the front-rear direction, which is located farther away from the first central line L1 than the second central line L2 and the fourth central line L4, thereby adjusting the impedance imbalance phenomenon caused by different widths between the first contact portion 3113, the first section 3111 and the second section 3112.

Referring to FIG. 1, FIG. 2 and FIG. 5, a third elastic arm 312 extends backward from the first retaining portion 310, and the third elastic arm 312 abuts a corresponding third protruding block 211. Specifically, an upper surface of the third elastic arm 312 in the upper row abuts the corresponding third protruding block 211 while a lower surface of the third elastic arm 312 in the upper row is exposed to the corresponding third protruding block 211, and the lower surface of the third elastic arm 312 in the lower row abuts the corresponding third protruding block 211 while the upper surface of the third elastic arm 312 in the lower row is exposed to the corresponding third protruding block 211. A central line of the third protruding block 211 in the front-rear direction overlaps with the first central line L1. The third elastic arm 312 also includes multiple portions having different widths, and central lines of these portions having different widths also have different distances from the first central line L1, which is similar to and can be referenced to the configuration of the first elastic arm 311, and details thereof are not hereinafter elaborated.

Referring to FIG. 2, FIG. 6 and FIG. 7, each of the ground terminals 32 has a second retaining portion 320 embedded in the insulating block 2A and further embedded in the second protruding block 202. Each of the left and right sides of the second retaining portion 320 has a second side surface 3201, and a distance between the two second side surfaces 3201 is equal to a width of the corresponding second protruding block 202, such that the two second side surfaces 3201 are respectively flush with the left and right side surfaces of the corresponding second protruding block 202 in the vertical direction. Thus, each second side surface 3201 is exposed in a corresponding slot 203. Each second side surface 3201 faces a first side surface 3101 adjacent thereto, and the medium between the first side surface 3101 and the second side surface 3201 is air, thereby increasing a directly facing area in air between the ground terminal 32 and the adjacent differential signal terminal 31. Since the dielectric constant of the air is less than the dielectric constant of the insulating block 2A, during the signal transmission of the terminal 3, the capacitance between the ground terminal 32 and the adjacent differential signal terminal 31 decreases due to the decrease of the dielectric constant. Further, the first side surface 3101 and the second side surface 3201 are exposed in the slot 203, and there is the air medium between the two surfaces, such that the directly facing area in air between the ground terminal 32 and the adjacent differential signal terminal 31 is increased, thereby inhibiting the decrease of the capacitance between the ground terminal 32 and the adjacent differential signal terminal 31, and inhibiting the amplitude of fluctuation of the impedance. Thus, the impedance is maintained at a relatively stable value, thereby reducing the transmission loss, reducing the cross talk, and facilitating the transmission of high-frequency signals.

Referring to FIG. 6 and FIG. 7, a second elastic arm 321 extends forward from the second retaining portion 320. The second elastic arm 321 extends forward out of the second protruding block 202 and is accommodated in a corresponding terminal slot 101, and is exposed in a corresponding accommodating slot 10 to be in electrical contact with the electronic card 200. A width of the second elastic arm 321 is equal to the width of the second protruding block 202, such that the width of the second retaining portion 320 in the second protruding block 202 is equal to the width of the second elastic arm 321, thereby facilitating a stable distance between the ground terminal 32 and the adjacent differential signal terminal 31, and further facilitating the impedance balance of the terminal 3. A length of the second elastic arm 321 is greater than a length of the second retaining portion 320. Since the dielectric constant of the air medium is less than the dielectric constant of the insulating block 2A, and the length of the second elastic arm 321 exposed to the air is greater than the length of the second retaining portion 320 embedded in the insulating block 2A, the impedance of the ground terminal 32 can be effectively adjusted, such that the value of the impedance of the second retaining portion 320 and the value of the impedance of the second elastic arm 321 do not fluctuate greatly, thereby reducing the transmission loss of high-frequency signals and reducing the cross talk, and further improving the high-frequency performance.

Referring to FIG. 5, FIG. 6 and FIG. 7, a fourth elastic arm 322 extends backward from the second retaining portion 320, and the fourth elastic arm 322 abuts the fourth protruding block 212. Specifically, an upper surface of the fourth elastic arm 322 in the upper row abuts the corresponding fourth protruding block 212 while a lower surface of the fourth elastic arm 322 in the upper row is exposed to the corresponding fourth protruding block 212, and the lower surface of the fourth elastic arm 322 in the lower row abuts the corresponding fourth protruding block 212 while the upper surface of the fourth elastic arm 322 in the lower row is exposed to the corresponding fourth protruding block 212.

Referring to FIG. 3, FIG. 4 and FIG. 5, the circuit board 300 is clamped between the third elastic arms 312 and fourth elastic arms 322 in the upper row and the third elastic arms 312 and fourth elastic arms 322 in the lower row, and the third elastic arms 312 and the fourth elastic arms 322 are one-to-one correspondingly surface-soldered to gaskets on the circuit board 300. When the circuit board 300 is inserted between the third elastic arms 312 and the fourth elastic arms 322 in the two rows, the third elastic arms 312 in the two rows are respectively deformed in the vertical direction, and the fourth elastic arms 322 in the two rows are respectively deformed in the vertical direction. The third protruding blocks 211 can prevent the corresponding third elastic arms 312 from excessive deformation, and the fourth protruding blocks 212 can prevent the corresponding fourth protruding blocks 212 from excessive deformation.

Referring to FIG. 3, FIG. 4 and FIG. 5, after the terminal modules 2 are one-by-one mounted forward to the mounting slots 11, the first elastic arms 311 and the second elastic arms 321 are accommodated in the corresponding terminal slots 101, and each slot 203 is located behind a corresponding partition wall 102, such that the partition wall 102 does not enter the slot 203, thereby ensuring that there is only air between the first side surface 3101 and the adjacent second side surface 3201, and facilitating the impedance balance of the terminals 3. The third protruding blocks 211 and the fourth protruding blocks 212 are exposed to the rear end of the insulating shell 1, and the circuit board 300 abuts and is in contact with the rear surface 21, thereby facilitating fixation of the circuit board 300.

To sum up, the electrical connector according to certain embodiments of the present invention has the following beneficial effects.

1. Each second side surface 3201 and a first side surface 3101 adjacent thereto are exposed in a corresponding slot 203, and the medium between the first side surface 3101 and the second side surface 3201 is air, thereby increasing a directly facing area in air between the ground terminal 32 and the adjacent differential signal terminal 31. Since the dielectric constant of the air is less than the dielectric constant of the insulating block 2A, during the signal transmission of the terminal 3, the capacitance between the ground terminal 32 and the adjacent differential signal terminal 31 decreases due to the decrease of the dielectric constant. Further, the first side surface 3101 and the second side surface 3201 are exposed in the slot 203, and there is the air medium between the two surfaces, such that the directly facing area in air between the ground terminal 32 and the adjacent differential signal terminal 31 is increased, thereby inhibiting the decrease of the capacitance between the ground terminal 32 and the adjacent differential signal terminal 31, and inhibiting the amplitude of fluctuation of the impedance. Thus, the impedance is maintained at a relatively stable value, thereby reducing the transmission loss, reducing the cross talk, and facilitating the transmission of high-frequency signals.

2. A length of the first elastic arm 311 is greater than a length of the first retaining portion 310. Since the dielectric constant of the air medium is less than the dielectric constant of the insulating block 2A, and the length of the first elastic arm 311 exposed to the air is greater than the length of the first retaining portion 310 embedded in the insulating block 2A, the impedance of the terminal 3 can be effectively adjusted, such that the value of the impedance of the first retaining portion 310 and the value of the impedance of the first elastic arm 311 do not fluctuate greatly, thereby reducing the transmission loss of high-frequency signals and reducing the cross talk, and further improving the high-frequency performance.

3. A length of the second elastic arm 321 is greater than a length of the second retaining portion 320. Since the dielectric constant of the air medium is less than the dielectric constant of the insulating block 2A, and the length of the second elastic arm 321 exposed to the air is greater than the length of the second retaining portion 320 embedded in the insulating block 2A, the impedance of the ground terminal 32 can be effectively adjusted, such that the value of the impedance of the second retaining portion 320 and the value of the impedance of the second elastic arm 321 do not fluctuate greatly, thereby reducing the transmission loss of high-frequency signals and reducing the cross talk, and further improving the high-frequency performance.

4. When the circuit board 300 is inserted between the third elastic arms 312 and the fourth elastic arms 322 in the two rows, the third elastic arms 312 in the two rows are respectively deformed in the vertical direction, and the fourth elastic arms 322 in the two rows are respectively deformed in the vertical direction. The third protruding blocks 211 can prevent the corresponding third elastic arms 312 from excessive deformation, and the fourth protruding blocks 212 can prevent the corresponding fourth protruding blocks 212 from excessive deformation.

5. A through slot 213 is provided between the third elastic arm 312 and the fourth elastic arm 322 adjacent to each other, and both sides of each of the fourth elastic arms 322 respectively have a through slot 213. When the ground terminals 32 and the differential signal terminals 31 are injection-molded with the insulating block 2A, the mold enters the through slots 213 to fix the ground terminals 32 and the differential signal terminals 31, thereby avoiding the misalignment between the ground terminals 32 and the differential signal terminals 31.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured for a mating component to be backwardly inserted thereto, the electrical connector comprising:

an insulating block, having a front surface, wherein a plurality of first protruding blocks and a plurality of second protruding blocks protrude and extend forward from the front surface, one of the first protruding blocks and one of the second protruding blocks are provided adjacent to each other, and a slot is formed between the one of the first protruding blocks and the one of the second protruding blocks adjacent to each other;

a plurality of differential signal terminals, embedded in the insulating block and forming a plurality of pairs of the differential signal terminals, wherein each of the differential signal terminals has a first retaining portion embedded in a corresponding first protruding block of the first protruding blocks, and a first elastic arm formed by extending forward from the first retaining portion and protruding forward out of the corresponding first protruding block, the first elastic arm is configured to be in electrical contact with the mating component, and each of a left side and a right side of each of the pairs of the differential signal terminals has a first side surface; and a plurality of ground terminals, embedded in the insulating block, wherein each of the ground terminals is provided between two adjacent pairs of the differential signal terminals, each of the ground terminals has a second retaining portion embedded in a corresponding second protruding block of the second protruding blocks, and a second elastic arm formed by extending forward from the second retaining portion and protruding forward out of the corresponding second protruding block, the second elastic arm is configured to be in electrical contact with the mating component, each of a left side and a right side of each of the ground terminals has a second side surface, and each of the second side surfaces and a corresponding first side surface adjacent thereto are exposed in the slot, such that a medium between the first side surface and the second side surface is air, wherein the insulating block further has a rear surface, the rear surface and the front surface are provided opposite to each other, the rear surface is backward protruding provided with a plurality of third protruding blocks and a plurality of fourth protruding blocks, the third protruding blocks and the first protruding blocks are one-to-one correspondingly provided in a front-rear direction, the fourth protruding blocks and the second protruding blocks are one-to-one correspondingly provided in the front-rear direction, and a through slot is formed between one of the third protruding blocks and one of the fourth protruding block adjacent to each other; and wherein each of the differential signal terminals further has a third elastic arm extending backward beyond a corresponding third protruding block of the third protruding blocks and configured to be electrically connected to a circuit board, each of the ground terminals has a fourth elastic arm extending backward beyond a corresponding fourth protruding block of the fourth protruding blocks and configured to be electrically connected the circuit board, and the through slot is located between the third elastic arm and the fourth elastic arm.

2. The electrical connector of claim 1, further comprising an insulating shell configured to accommodate the mating component, wherein the insulating shell has a plurality of terminal slots, a partition wall is provided between two adjacent ones of the terminal slots, the first elastic arm and the second elastic arm are respectively correspondingly accommodated in the terminal slots, and the slot is located behind the partition wall.

3. The electrical connector of claim 1, wherein a width of each of the first protruding blocks is greater than a width of each of the second protruding blocks, the width of each of the first protruding blocks is equal to a width of each of the third protruding blocks, and the width of each of the second protruding blocks is equal to a width of each of the fourth protruding blocks.

4. The electrical connector of claim 1, wherein one of an upper surface and a lower surface of the third elastic arm is abutted by the corresponding third protruding block, the other of the upper surface and the lower surface of the third elastic arm is exposed to the corresponding third protruding block, one of an upper surface and a lower surface of the fourth elastic arm is abutted by the corresponding fourth protruding block, and the other the upper surface and the lower surface of the fourth elastic arm is exposed to the corresponding fourth protruding block.

5. The electrical connector of claim 1, wherein a length of the first elastic arm is greater than a length of the first retaining portion; and a length of the second elastic arm is greater than a length of the second retaining portion.

6. The electrical connector of claim 1, wherein a left side surface and a right side surface of each of the first protruding blocks are respectively correspondingly flush with two corresponding ones of the first side surfaces.

7. The electrical connector of claim 1, wherein two corresponding ones of the second side surfaces are respectively flush with a left side surface and a right side surface of each of the second protruding blocks.

8. The electrical connector of claim 1, wherein the first elastic arm has a first contact portion electrically connected with the mating component, a width of the first contact portion is less than a width of each of the first protruding blocks, the second elastic arm has a second contact portion mated with the mating component, a width of the second contact portion is less than a width of each of the second protruding blocks, and a distance between the first contact portion and an adjacent second contact portion is greater than a distance between the one of the first protruding blocks and the one of the second protruding blocks adjacent to each other.

9. The electrical connector of claim 1, wherein a left side surface and a right side surface of each of the first protruding blocks are respectively correspondingly flush with two corresponding ones of the first side surfaces, and two corresponding ones of the second side surfaces are respectively flush with a left side surface and a right side surface of each of the second protruding blocks.

10. The electrical connector of claim 1, wherein the insulating block has a hole located on a rear side of the slot, and the first retaining portion is at least partially exposed in the hole.

11. The electrical connector of claim 10, wherein a center of the first retaining portion has a narrow portion, a width of the narrow portion is less than a width of each of a front end and a rear end of the first retaining portion, and the narrow portion is exposed in the hole.

12. The electrical connector of claim 1, wherein the first retaining portions of each of the pairs of the differential signal terminals are embedded in a same corresponding one of the first protruding blocks, each of the first elastic arms of each of the pairs of the differential signal terminals has a first section connected to the same corresponding one of the first protruding blocks, the same corresponding one of the first protruding blocks defines a first central line in a front-rear direction, the first section of each of the first elastic arms of each of the pairs of the differential signal terminals defines a second central line in the front-rear direction, and two adjacent second central lines are symmetrical to each other about the first central line.

13. The electrical connector of claim 12, wherein a first contact portion is formed at an end of the first elastic arm to be electrically connected to the mating component, a width of the first contact portion is less than a width of the first section, the first contact portion defines a third central line in the front-rear direction, and the third central line is located farther away from the first central line than the second central line.

14. The electrical connector of claim 13, wherein a second section connects the first contact portion and the first section, a width of the second section is less than the width of the first section and is greater than the width of the first contact portion, the second section defines a fourth central line in the front-rear direction, and the fourth central line is located closer to the first central line than the second central line.

15. An electrical connector, configured for a mating component to be backwardly inserted thereto, the electrical connector comprising:

an insulating block, having a front surface, wherein a plurality of first protruding blocks and a plurality of second protruding blocks protrude and extend forward from the front surface, one of the first protruding blocks and one of the second protruding blocks are provided adjacent to each other, and a slot is formed between the one of the first protruding blocks and the one of the second protruding blocks adjacent to each other;

a plurality of differential signal terminals, embedded in the insulating block and forming a plurality of pairs of the differential signal terminals, wherein each of the differential signal terminals has a first retaining portion embedded in a corresponding first protruding block of the first protruding blocks, and a first elastic arm formed by extending forward from the first retaining portion and protruding forward out of the corresponding first protruding block, the first elastic arm is configured to be in electrical contact with the mating component, and each of a left side and a right side of each of the pairs of the differential signal terminals has a first side surface; and a plurality of ground terminals, embedded in the insulating block, wherein each of the ground terminals is provided between two adjacent pairs of the differential signal terminals, each of the ground terminals has a second retaining portion embedded in a corresponding second protruding block of the second protruding blocks, and a second elastic arm formed by extending forward from the second retaining portion and protruding forward out of the corresponding second protruding block, the second elastic arm is configured to be in electrical contact with the mating component, each of a left side and a right side of each of the ground terminals has a second side surface, and each of the second side surfaces and a corresponding first side surface adjacent thereto are exposed in the slot, such that a medium between the first side surface and the second side surface is air, wherein the first retaining portions of each of the pairs of the differential signal terminals are embedded in a same corresponding one of the first protruding blocks, each of the first elastic arms of each of the pairs of the differential signal terminals has a first section connected to the same corresponding one of the first protruding blocks, the same corresponding one of the first protruding blocks defines a first central line in a front-rear direction, the first section of each of the first elastic arms of each of the pairs of the differential signal terminals defines a second central line in the front-rear direction, and two adjacent second central lines are symmetrical to each other about the first central line; and wherein a first contact portion is formed at an end of the first elastic arm to be electrically connected to the mating component, a width of the first contact portion is less than a width of the first section, the first contact portion defines a third central line in the front-rear direction, and the third central line is located farther away from the first central line than the second central line.

16. The electrical connector of claim 15, wherein a length of the first elastic arm is greater than a length of the first retaining portion; and a length of the second elastic arm is greater than a length of the second retaining portion.

17. The electrical connector of claim 15, wherein a second section connects the first contact portion and the first section, a width of the second section is less than the width of the first section and is greater than the width of the first contact portion, the second section defines a fourth central line in the front-rear direction, and the fourth central line is located closer to the first central line than the second central line.

18. The electrical connector of claim 15, wherein the insulating block has a hole located on a rear side of the slot, and the first retaining portion is at least partially exposed in the hole.

19. The electrical connector of claim 18, wherein a center of the first retaining portion has a narrow portion, a width of the narrow portion is less than a width of each of a front end and a rear end of the first retaining portion, and the narrow portion is exposed in the hole.

* * * * *